United States Patent [19]

Valley

[11] Patent Number: 4,879,965

[45] Date of Patent: Nov. 14, 1989

[54] AIRPORT TWENTY-FOUR HOUR PILOT INFORMATION MARKERS

[76] Inventor: Irvin L. Valley, 1580 Weathervane Dr., Fircrest, Wash. 98466

[21] Appl. No.: 616,266

[22] Filed: May 31, 1984

[51] Int. Cl.[4] ..... G09F 7/00; G09F 13/00

[52] U.S. Cl. ..... 116/209; 40/217; 40/602; 40/612; 40/541; 116/63 R

[58] Field of Search ..... 116/63 R, 202, 209; 40/217, 602, 606, 607, 611, 612, 617, 618, 541, 542, 575, 576, 582, 583; 244/114 R; 248/530, 532, 533

[56] References Cited

U.S. PATENT DOCUMENTS

| | | | |
|---|---|---|---|
| 207,549 | 8/1907 | Powell | 40/607 |
| 905,228 | 12/1908 | Reeser | 40/607 |
| 1,164,909 | 12/1915 | Auberlin | 116/63 R |
| 1,845,590 | 2/1932 | Edwards | 40/602 |
| 2,221,606 | 11/1940 | Piacentini | 40/217 |
| 2,840,942 | 7/1958 | Ryan | 40/606 |
| 2,841,902 | 7/1958 | Pfundt | 40/602 |
| 2,940,198 | 6/1960 | Ressel | 40/607 |
| 3,038,271 | 6/1962 | MacHutchin et al. | 40/542 |
| 3,396,483 | 8/1968 | Stein et al. | 40/607 |
| 3,521,390 | 7/1970 | Carlson | 40/602 |
| 3,972,107 | 8/1976 | Deike | 116/63 R |
| 3,984,069 | 10/1976 | Heyworth | 40/217 |
| 4,248,001 | 2/1981 | Feuvray | 40/602 |
| 4,298,292 | 11/1981 | Sweeney | 40/606 |

FOREIGN PATENT DOCUMENTS

| | | | |
|---|---|---|---|
| 572131 | 12/1975 | Switzerland | 404/10 |

OTHER PUBLICATIONS

"Air Marking," Dept. of Commerce, Aeronautics Bulletin, No. 4, Jul. 1, 1929.

*Primary Examiner*—William A. Cuchlinski, Jr.
*Assistant Examiner*—Patrick R. Scanlon
*Attorney, Agent, or Firm*—Roy E. Mattern, Jr.

[57] ABSTRACT

Airport twenty-four hour pilot information markers are provided to tell the pilot: upon takeoff or landing how many feet of runway remain; before takeoff or after landing what taxiway he or she is to follow; what is the direction, inboard, outboard, north, south, east, or west, etc.; what is the intersection; what is the holding position; and/or what is the destination; etc. In respect to a runway distance remaining embodiment, the construction and installation is as follows: a four feet square aluminum sheet, at least one hundred thousandths of an inch thick has high intensity reflective Scotchlite reflective material, applied to each side, with white denoting the numeral and green the background, to reflect the light of airplane landing lights; each Scotchlite covered sheet is then pivotally supported one foot down from the top along each side to a 1½ fiberglass pipe; in turn below telescopically received in a 2" fiberglass pipe; in turn cemented in place in the ground, often utilizing a transverse holding pin; and transverse adjustment and holding pins are directed through the 2" and 1½" fiberglass pipes just about ground level, when the top edge of this pilot information marker is level, thereby fully retaining the information marker. Near ground level the 1½ foot fiberglass pipes preferably have a frangible portion which breaks, if an airplane in making a deviated landing, strikes the information marker. Another embodiment utilizes two four feet square aluminum sheets, having only one side of each sheet covered with green and white Scotchlite reflective material, removably placed in a frame supporting them. The frame is in turn supported in like manner. Another embodiment includes the select placement of radio isotopes in tubes, such as tritium in tubes, to create illuminated information markers, where they are not positioned to reflect the light from landing lights of airplanes, or where such tritium energy lighting is used in conjunction with reflective informational markers.

6 Claims, 3 Drawing Sheets

FIG. 1
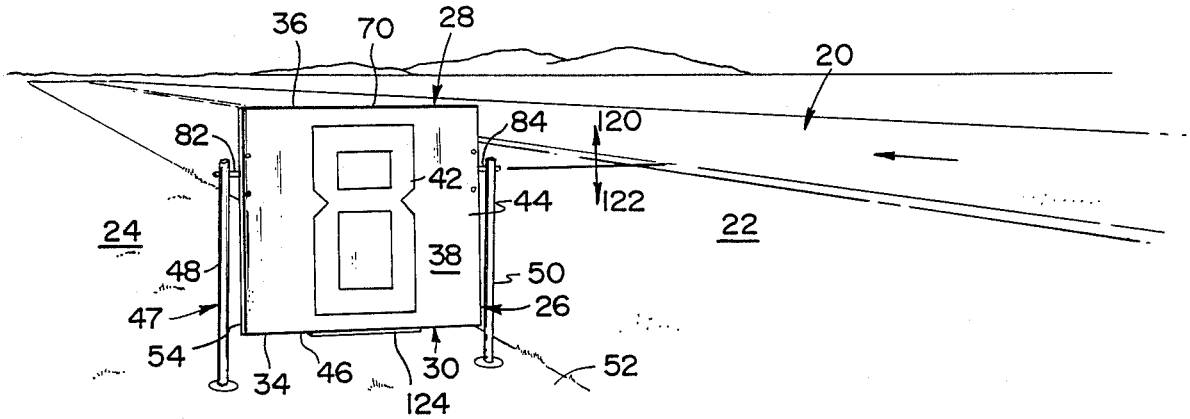
FIG. 2
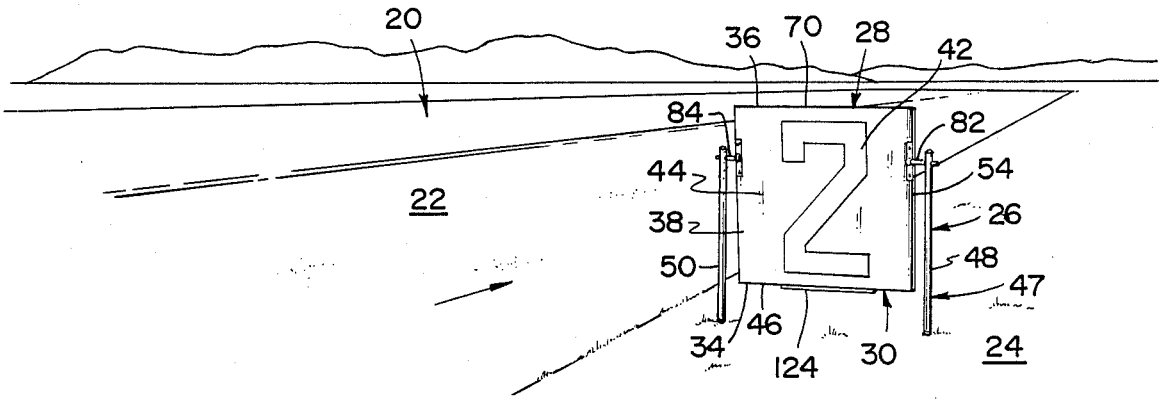
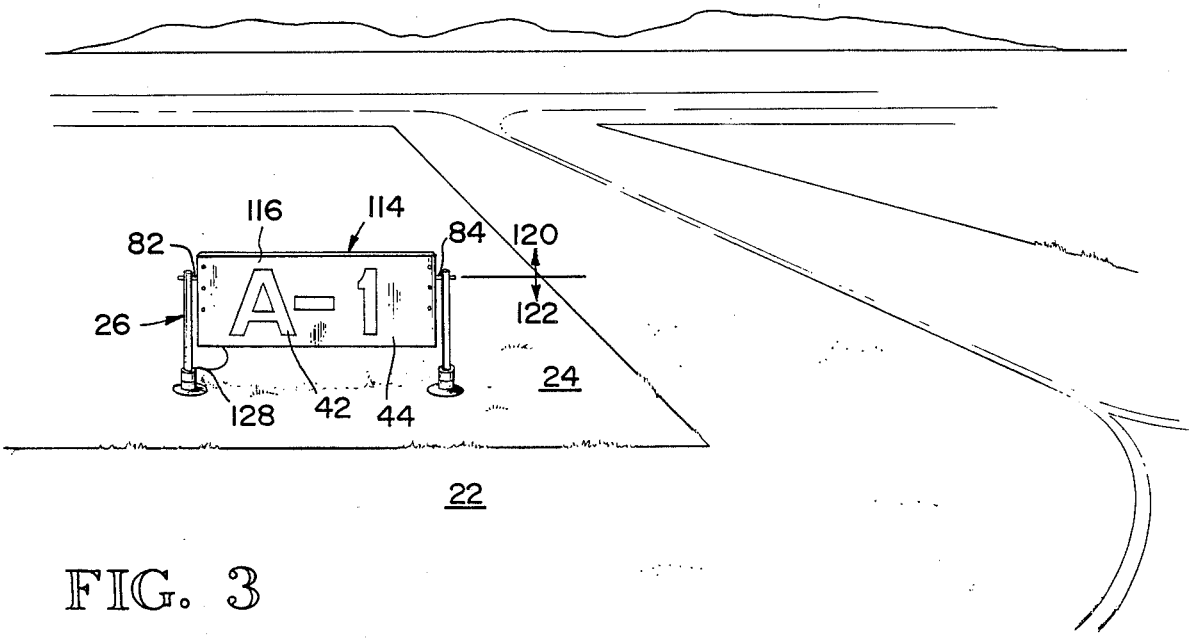
FIG. 3

AIRPORT TWENTY-FOUR HOUR PILOT INFORMATION MARKERS

BACKGROUND

The need for airport runway distance markers is set forth by Eugene R. Heyworth in his U.S. Pat. No. 3,984,069 wherein he illustrates and describes his translucent truncated pyramids mounted over spaced runway lights to present distance information to pilots. An advisory circular 150/5340-18B of the Federal Aviation Administration indicates what other information markers are needed at airports. An Air Force Engineering and Services Center Report of May 1981, ESL-TR-81-45 describes the testing of tritium powered airport runway distance and taxiway markers to be used in lieu of electric lighting or where electric lighting is not possible. Luminous portable folding airstrip markers are disclosed by Hazel C. O'Connor in her U.S. Pat. No. 2,667,000. Irvin L. Valley in his U.S. Pat. No. 3,916,815 disclosed his cylindrical runway markers around which he applied bands of fluorescent Scotchcal and high intensity Scotchlite. In his U.S. Pat. No. 1,846,943 Denford A. Brumbaugh disclosed how highway information signs could be constructed with frames swingably supporting the indicia panels. Now Irvin L. Valley has combined all this prior representative information to provide various embodiments of airport twenty-four hour pilot information markers.

SUMMARY

Airport twenty-four hour pilot information markers are provided in various embodiments for selection and use about airports, which will enable a pilot landing at any time to he able to read these information markers, so he or she will know: how much runway is left during takeoff or landing; which taxiway to use; and what other aspects of the ground control directions are to be followed.

In a basic embodiment of a runway remaining distance marker, an aluminum sheet, four feet by four feet, is covered on respective sides with white Scotchlite reflective material formed in a numeral surrounded by a green Scotchlite reflective material. One foot down on each side of the numeral bearing sheet there are rotatable mounts, which pivotally suspend the informational marker from adjacent vertical telescoping uprights. One larger diameter telescoping upright is anchored into the ground with cement, often using a transverse holding pin. Then a smaller diameter telescoping member is first adjusted in height to make the top edge of the sheet or panel horizontal, and then thereafter it is secured to the larger diameter telescoping upright by a cross pin.

Where runway lengths vary or are intended to be changed, instead of one sheet being numbered directly on both sides, such as an information marker marked with a two on one side and with an eight on the other side, with respect to a ten thousand foot runway, then an embodiment is provided to use two removable aluminum sheets within a frame, with a Scotchlite numeral being only shown on one side of each sheet or panel. Using this interchangeable numeral embodiment, airport personnel are able to conveniently make changes, when runway distances are changed.

Where information markers are not in positions to reflect airplane runway lights at all, or for only limited times, then the frames of the information markers include not only the Scotchlite materials on panels, but the panels will allow the projection of the light energy of radio isotopes, such as tritium, contained in pyrex glass tubes, in turn positioned between the frames to create the numeral images directly or by outlining them.

As so constructed and so swingably mounted, these airport pilot information markers are reliably offering pilots landing, takeoff and taxiing information during the entire twenty-four hours of each day. Many airports previously only open for daytime landings, if equipped with these information markers, will be able to receive airplanes for night landings. Moreover, those storm protected airport twenty-four hour pilot information markers will be added safety aids in emergency situations, such as occur during electrical power failures.

DRAWINGS

Preferred embodiments of the airport twenty-four hour pilot information markers are illustrated in the drawings, wherein:

FIGS. 1 and 2 are perspective views of an airport twenty-four hour pilot information marker serving to tell a pilot how much farther the runway extends in the direction he is viewing upon takeoff or landing, such as the numeral eight in FIG. 1, for indicating eight thousand feet are left of a ten thousand foot runway, and as the numeral two in FIG. 2, located on the back of the sheet bearing numeral eight, on this same runway, for indicating two thousand feet of runway are left in the other direction;

FIG. 3 is a perspective view of an airport twenty-four hour pilot information marker serving to tell a pilot which taxiway he is to use, such as taxiway A-1;

Figure 6:
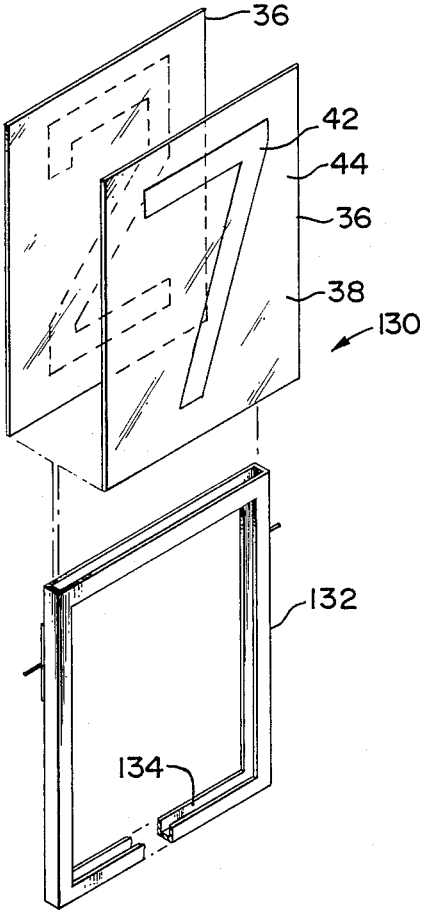
Figure 7:
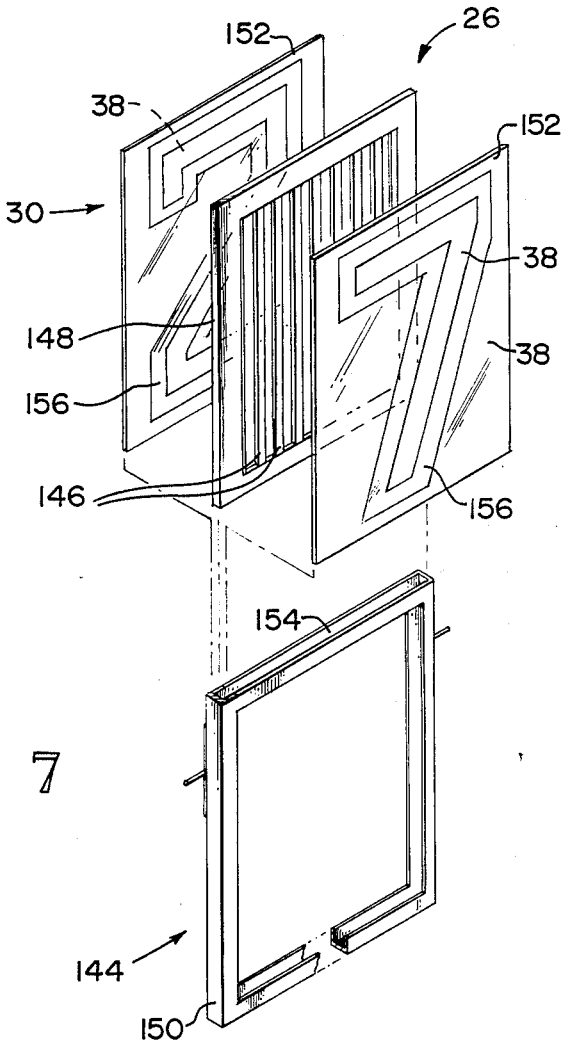

FIG. 6 is an end view of another embodiment wherein a frame receives two numeral sheets or panels, each bearing one numeral displayed on only one of its sides, thereby giving airport personnel the opportunity of revising the airport twenty-four hour pilot information runway distance markers, if a runway is extended or shortened; and FIG. 7 is a perspective end view indicating how a space between sheets or panels bearing information, is selectively arranged with pyrex glass tubes containing the radio isotope of tritium, to create a numeral or to effectively outline a numeral by the radiated light, during the dusk and darker portions of a day, whereby pilot information markers, not receiving the light from the landing lights of an airplane, nevertheless may be observed by the pilot, while he is landing and then taxiing, or taxiing and then taking off in his airplane.

DESCRIPTION OF PREFERRED EMBODIMENTS

Introduction to the Embodiments

All the embodiments of these airport twenty-four hour pilot information markers, upon reflection of the landing lights of airplanes, convey information, via various indicia, to pilots as they maneuver their airplanes about airports. In some embodiments radiant energy light sources are used, so a pilot is able to obtain information from observing one or more of these airport information markers, even though one or more of these particular markers are not positioned to reflect airplane running lights at all, or only for limited directional maneuvering times; or the airplane running lights have failed or are inadequate; and/or the reflective display of information on some of the airport information markers at certain times of limited visibility or during adverse weather conditions could use supplemental display energy. In all embodiments these markers are secured to withstand high winds, to avoid improper withdrawal by unauthorized persons, and to break away, if struck by an airplane. The collective information made available to the pilots, via these airport twenty-four hour pilot information markers, makes it possible for them, in conjunction with maps or charts of airports, and/or with radio communications carried on with airport personnel, to safely, accurately, conveniently, and without hesitation, maneuver their airplanes about all the respective airports, where these airport twenty-four hour pilot information markers are installed.

Introduction to Embodiments Marking Distances in Respect to Airport Runways

In FIGS. 1 and 2, for example, a ten thousand foot airport runway 20 is shown having a concrete strip 22 and clearance strips 24. In FIG. 1, a pilot landing or taking off in the direction indicated by the arrow, learns that he or she has eight thousand feet of runway remaining. He or she observes the airport twenty-four hour pilot information marker 26, which in this illustrated single aluminum sheet embodiment 28, is serving as an airport runway distance marker 30. In FIG. 2, the same airport runway at the same location is shown, however a pilot landing or taking off in the opposite direction, indicated by the arrow, learns that he or she has two thousand feet of runway remaining.

Although not shown, there is preferably an airport runway distance marker 30, placed at this same distance location at the opposite side of the airport runway 20. Also at each thousand foot location, a pair of these airport runway distance markers 30 are preferably installed. Each marker 30 bears two numerals, one on each side, in the preferred respective pairs of: 0-10, 1-9, 2-8, 3-7, 4-6, 5-5, 6-4, 7-3, 8-2, 9-1, 10-0, in respect to their installation on a ten thousand foot runway, when being observed during travel from one end of an airport runway 20 to the other end.

Airport Runway Distance Marker Embodiment, Using a Single Sheet of Aluminum in Displaying the Numerals As illustrated in FIGS. 1 and 2, in respect to displaying of numerals, a single sheet 34 of aluminum, plywood or fiberglass, is used in an embodiment 28 of an airport runway distance marker 30, serving as an airport twenty-four hour pilot information marker 26. Thicknesses of one hundred or one hundred twenty-five thousandths are preferably used in four foot square panels 36 of aluminum In this embodiment 28, on each side of the panel 36, white and green Scotchlite high intensity reflective materials 38, with pressure sensitive adhesive backings 40, are installed.

Preferably, the numerals 42 are white and the background 44 is green. Other color contrasts could be used. Scotchlite materials 38 are products manufactured by the so called 3M Company. Other reflective products could be used. The numeral sizes are standardized. Each numeral 42 is forty inches high, and depending on the numerals, the widths vary from six inches for the one to thirty-eight inches for the twelve, with most of the numerals 42 being twenty-two inches wide such as the two and three numerals.

These reflective material 38 covered panels 36 are pivotally supported on an overall mounting assembly 47, having left and right support assemblies 48, 50, with their bottom edge 46 being one foot above ground level 52 of the clearance strips 24, and with their nearest vertical edge 54 being fifty feet away from the edge of the concrete strip 22 of the airport runway 20. These support assemblies 48, 50 and the panels 36 are arranged in a geometric plane, which is perpendicular to a respective edge 56 of a concrete strip 22 of an airport runway 20.

Each support assembly 48 or 50, is spaced with one inch clearance from a vertical edge 54 and positioned parallel to a respective vertical edge 54 of the panel 36. Two telescoping fiberglass pipes 58, 60 are used in each assembly 48 or 50. Of these two pipes 58, 60, one base or ground pipe 58 is two inches in diameter, two feet long, having a wall thickness of one quarter of an inch. Twenty-two inches of the base pipe 58 are positioned in surrounding poured concrete 62, and a bottom cap 64 is used to prevent concrete from entering the interior 66 of this base pipe 58. Also a transverse or cross stop pin 68 is used to prevent any vertical pullout of the base pipe 58. About forty-five pounds of poured concrete 62 are used to surround one base pipe 58.

Of these two pipes 58, 60, the standing pipe 60 is one and one half inches in diameter, five feet long, having a wall thickness of one quarter of an inch. About fourteen inches of this standing pipe 60 is initially inserted down into the base pipe 58, until contacting the cross stop pin 68. Later, during the final adjustments in the mounting of the airport runway distance marker 30, the standing pipe 60 may be slightly raised above the cross stop pin 68 in positioning the panel 36, so the top edge 70 of the pane 36 will be horizontal. A cross positioning and holding fastener assembly 72 of a bolt 74, washer 76, and lock nut 78, is used to hold these two pipes 58, 60 in their selected telescoping positions, while the panel 36 is pivotally held in position, a shown in FIGS. 1 and 2.

Figure 5:
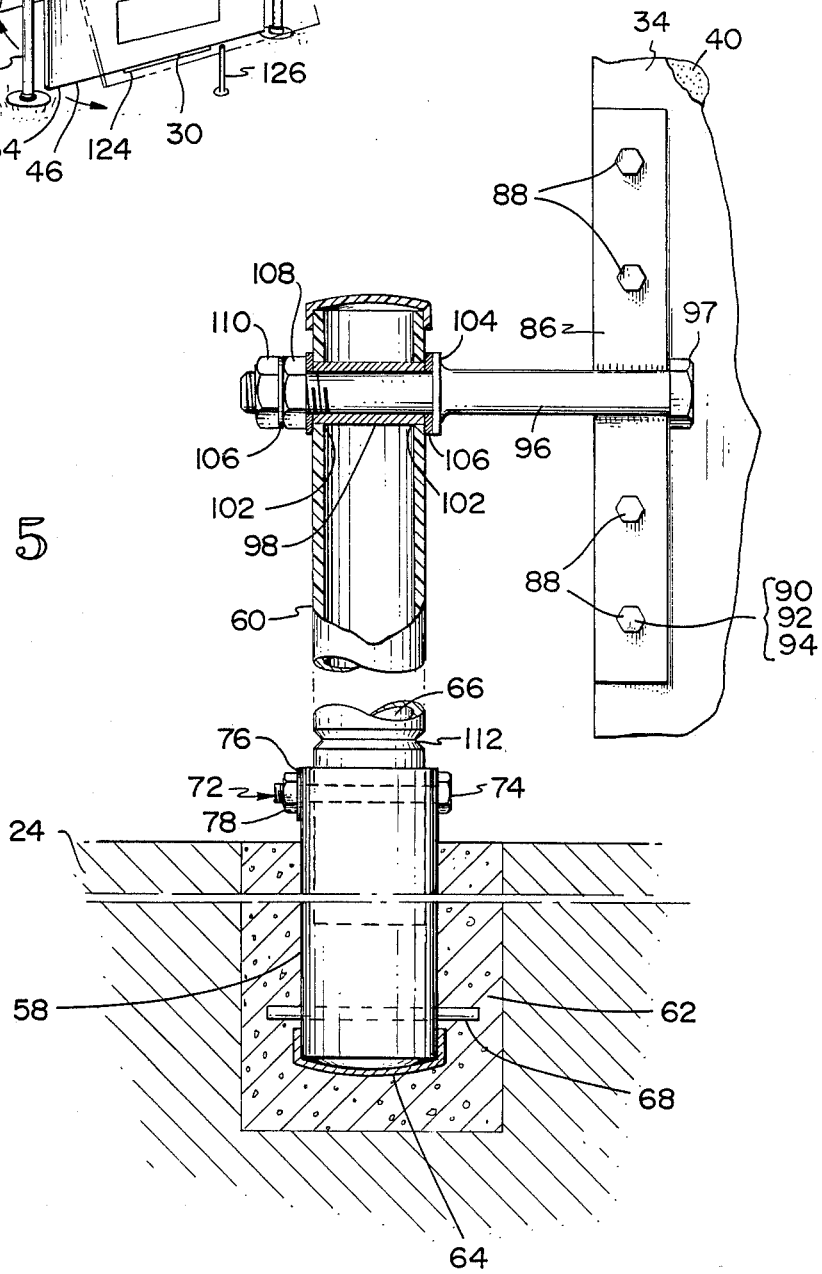
FIG. 5 is an enlarged front view with some portions removed, broken away, or sectioned, to indicate how the airport twenty-four hour pilot information marker, serving to indicate runway distances that remain, is removably mounted and secured to telescoping frame members, one of each pair of these members being cemented into place in the earth adjacent to a runway.

The pivotal mounting f the panel 36 to respective left and right support assembles 48, 50 is undertaken by using respective left and right pivotal assembles 82, 84, which each have an elongated mounting bar 86, eight inches in length, for mounting to the panel 36, by using four spaced fastener assemblies 88, having a bolt 90, washer 92, and nut 94, with this bar 86 in turn being welded to an elongated bolt 96 near the bolt head 97, as shown in FIG. 5. This elongated bolt 96, passes through Oilite bushings 98, in turn secured to the standing pipe 60 at transverse holes 102 drilled in each pipe 60, until the passing through is stopped by the positioning flange 104 welded to axial bolt 96. A washer 106 is preferably used at this location between the positioning flange 104 and the exterior of the standing pipe 60. To keep the elongated bolt 96 in its axial position in the standing pipe 60, a washer 106 is placed around its threaded and extending end and against the exterior of the standing pipe 60, followed by the surrounding placement of a nut 108, two washers 106, and a jam nut 110, which are thereafter tightened to complete a left or right pivotal assembly 82 or 84.

When desired or specified, the standing pipe 60 above and nearby where it enters the base pipe 58 is grooved about ten thousandths of an inch to create a frangible section 112. If an airplane unwantedly travels on a clearance strip 24 and strikes an airport runway distance marker 30, the frangible sections 112 insure the prompt clearance of these runway distance markers 30, or other airport twenty-four hour pilot information markers 26.

Airport Taxi-way Identification Marker

In FIG. 3, an airport taxiway identification marker 114 is illustrated, which informs a pilot which taxiway he or she is approaching. Aluminum panels 116, generally of a smaller size, are likewise covered with Scotchlite reflective materials 38 presenting information such as, A-1, designating one of several taxiways at an airport, where these airport twenty-four pilot information markers 26 are installed. Like or similar mounting equipment and procedures as those illustrated and described in reference to airport runway distance marker 30 are likewise pertinent to these taxiway markers 114. Other directional and locational information is presented on like or similar identification markers.

Provisions Made to accommodate Adverse Weather Conditions

Figure 4:
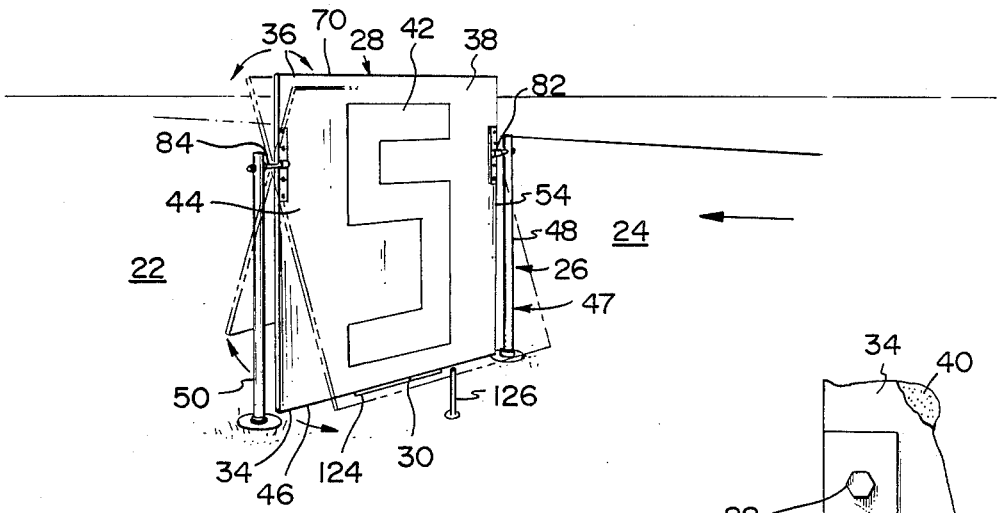
FIG. 4 is a perspective view indicating how the airport twenty-four hour pilot information markers will pivot during wind storms, and their range of pivoting may be limited by an impact stake, which during snow and ice storms jars the collecting snow and/or ice from the faces of the respective marker.

As illustrated in FIG. 4, by an arrow showing the direction of strong winds, and a curved arrow indicating a deflecting pivoting of a panel 36, the airport twenty-four hour pilot information markers 26 will swing under wind pressure. The panels 36 of the airport runway distance markers 30, by their pivotal mounting, with a smaller top area 120 located above the elongated axle bolts 96 than the larger bottom area 122 located below the axle bolts 96, results in excellent deflection in strong winds coupled with a quick return to the vertical position, when the winds substantially decrease. If necessary a ballast portion 124 is optionally added where there are always strong winds.

Also if necessary strike stakes 126 are positioned so as snow accumulates on a panel 36, the impacting of the panel 36 on a respective strike stake 126 knocks any snow off of the panel 36. Where very extreme wind storms are known to sometimes occur, this strike stake 126 also prevents any flip-flop of the panel 36. Where strike stakes 126 are not needed but a flip-flop of a panel 36 might be possible, tethers 128 are installed.

Interchangeable Dual Panels

In respect to the airport runway distance markers 30 illustrated in FIGS. 1, 2, 4 and 5, only the one panel 36 f aluminum is used and each side is covered with Scotchlite reflective material 38 arranged in numerals which are different, except for the midway distance. For each airport runway 20, these runway distance markers 30 are therefore essentially tailor-made. If airports are changed in respect to runway length, the panels 36 of these tailor-made runway distance markers 30 must be replaced or redone. For this reason and/or other reasons such as installers having fewer parts on hand or in inventory, the interchangeable dual panel embodiment 130 illustrated in FIG. 6 is available. The principal differences, in respect to the single aluminum sheet embodiment 28, are a frame 132 to position two panels 36, and each of these panels 36 has a numeral reflectively indicated only on one side. Also a change is preferred in the mounting by using another bar 86, so there will be a mounting bar 86 on each side of the frame 132. The other mounting components illustrated in FIG. 5 are used. The frame 132 preferably provides a receiving slot 134 to position the panels 36.

Lighting Supplied Via Energy of Radio Isotopes

In FIG. 7, the radio isotope embodiment 144 of an airport runway distance marker 30 or other airport twenty-four hour pilot information marker 26, is illustrated or indicated. Pyrex glass tubes 146 containing the radio isotope of tritium are available. The selective placement of these tubes 146 in a holder 148, in turn positioned in slot 154 of a frame 150, with panels 152, creates this radio isotope embodiment 144.

Therefore in addition to having reflective material 38 covering numeral and partial background portions of a panel 152, there are selectively arranged transparent materials 156 about each numeral, whereby the light created by the tritium is observable by pilots. The lighted images created present numeral information and other airport information to pilots during their night maneuvering around airports, without the necessity of a pilot specifically directing a light from his or her airplane to create a reflective image from an airport twenty-four hour pilot information marker 26.

Yet during the daytime, the panels 152 are very readable. Also at night, if light does reflect, the panels 152 are also very readable. Then there is the constant twenty-four hour availability of this light from the tritium radio isotope Pyrex tube 146, to convey information during the heavy overcast, poor daylight conditions.

The mounting arrangements shown or indicated in reference to the other embodiments are used. The mounting objectives always remain, whereby the airport twenty-four hour pilot information markers 26 are to remain functionally in place during all types of weather conditions, to be readily observed by a pilot during his or her maneuvering around an airport.

I claim:

1. An airport twenty-four hour pilot information marker, comprising:

(a) a rectangular planar panel means having reflective material on each side arranged in contrasting reflective patterns to create pilot informative indicia;

(b) an overall mounting assembly to pivotally support the panel means above the ground, whereby the panel means may deflect when the wind blows, and yet be positioned at all times to reflect airplane landing light energy, thereby to inform the pilot of indicia information, which is of value to him or to her, when he or she is maneuvering an airplane around an airport, having right and left pivotal assemblies attached to the rectangular planar panel means at opposite edges thereof, at locations below the top of this panel means, to thereby locate a smaller area of this panel means above these pivotal assemblies, and a larger area of this panel means below these pivotal assemblies, with each of these pivotal assemblies having:

(1) an axis bolt rotatably supported in a respective support assembly;
(2) a fastener means to hold the axis bolt in place;
(3) an elongated bar secured to the axis bolt and fitted to the panel means;
(4) a fastener means to hold the panel means against the elongated bar; and right and left support assemblies pivotally receiving near their tops the respective axis bolts, with each of these support assemblies having;

(1) a base pipe for placement in the ground;
(2) a standing pipe for partial telescoping insertion into the base pipe and supporting a pivotal assembly;
(3) a positioning means to hold the standing pipe in a selected inserted position within the base pipe;
(4) a transverse cross stop pin selectively placed in this base pipe to hold this base pipe in a relative depth position in the ground;
(5) concrete poured about the lower portions of this base pipe and completely about this transverse cross stop pin;
(6) a transverse fastener assembly to selectively position this standing pipe down into this base pipe; and
(7) sealing caps for the top of this standing pipe and for the bottom o this base pipe to keep their interiors cleaner and drier.

2. An airport twenty-four hour pilot information marker, as claimed in claim 1, wherein said panel means comprises, a frame mounted to the right and left pivotal assemblies one and two panels arranged within this frame each having reflective material on one side arranged in contrasting reflective patterns to create informative indicia.

3. An airport twenty-four hour pilot information marker, as claimed in claim 2, wherein Pyrex glass tubes each containing a radio isotope are placed within the framed and between the two panels to supply back lighting of the indicia observable during hours of poor daylight or during night time.

4. An airport twenty-four hour pilot information marker, as claimed in claim 1 having a restraining means to prevent a complete rotation of the rectangular planar panel means.

5. An airport twenty-four hour pilot information marker, as claimed in claim 2 having a restraint means to prevent a complete rotation of the rectangular planar panel means.

6. An airport twenty-four hour pilot information marker, as claimed in claim 3 having a restraint means to prevent a complete rotation of the rectangular planar panel means.

* * * * *